US005192199A

United States Patent [19]

Olofsson

[11] Patent Number: 5,192,199

[45] Date of Patent: Mar. 9, 1993

[54] MACHINE FOR A GASEOUS MEDIUM

[75] Inventor: Hans Olofsson, Huddinge, Sweden

[73] Assignee: Svenska Rotor Maskiner AB, Stockholm, Sweden

[21] Appl. No.: 663,858

[22] PCT Filed: Sep. 20, 1989

[86] PCT No.: PCT/SE89/00505

§ 371 Date: Mar. 12, 1991

§ 102(e) Date: Mar. 12, 1991

[87] PCT Pub. No.: WO90/04107

PCT Pub. Date: Apr. 19, 1990

[30] Foreign Application Priority Data

Oct. 11, 1988 [SE] Sweden ..... 8803595

[51] Int. Cl.[5] ..... F04B 17/00

[52] U.S. Cl. ..... 417/406

[58] Field of Search ..... 417/405, 406, 408, 391; 418/201.3

[56] References Cited

U.S. PATENT DOCUMENTS

| | | | |
|---|---|---|---|
| 2,100,560 | 11/1937 | Kennedy | 417/406 |
| 2,147,522 | 10/1939 | Lysholm | 418/201.3 |
| 2,622,787 | 12/1952 | Nilsson | 418/201.3 |
| 2,922,377 | 1/1960 | Whitfield | 418/201.3 |
| 3,807,911 | 4/1974 | Caffrey . | |
| 4,291,547 | 9/1981 | Leo . | |
| 4,311,021 | 1/1982 | Leo . | |
| 4,328,684 | 5/1982 | Leo . | |
| 4,820,135 | 4/1989 | Simmons | 417/406 |
| 4,828,036 | 5/1989 | Simmons | 417/406 |

FOREIGN PATENT DOCUMENTS 1811284 8/1973 Fed. Rep. of Germany .

OTHER PUBLICATIONS

Herbert Ossenbuhl, "Versuche mit einem neuartigen Blasluftumformer auf der Zeche Osterfeld", Gluckauf, Sep. 1960, pp. 576-577.

*Primary Examiner*—Richard A. Bertsch
*Assistant Examiner*—Timothy S. Thorpe
*Attorney, Agent, or Firm*—Frishauf, Holtz, Goodman & Woodward

[57] ABSTRACT

The invention relates to a machine of the rotary screw type for a gaseous medium having a compression section and an expansion section driving the compression section. According to the invention both the compression section and the expansion section are located in one single working space in which two rotors (14, 16) operate. The machine has a low pressure port (32), a high pressure port (30) and intermediate pressure port means (34).

5 Claims, 3 Drawing Sheets

MACHINE FOR A GASEOUS MEDIUM

The present invention relates to a machine of the rotary screw type for a gaseous medium having a compression section and an expansion section driving the compression section.

In a compressor a gaseous medium is compressed to a higher pressure which consumes power. In an expander a gaseous medium is expanded which generates power. It is thus possible to drive a compressor by use of an expander. An example of this is disclosed in DE-PS 1 811 284 showing a rotary screw compressor driven by a rotary screw expander. A similar example is disclosed in an article in the magazine "Glückauf" 9/1960, pages 576 and 577.

According to known technique in this field, as exemplified by the above cited references, the compressor and the expander are made as separate units, each one having its own separate working space with inlet and outlet ports and being connected only by the common driving shafts. Such a construction of an expander-driven compressor therefore will be relatively complicated.

The object of the present invention is to make an expander-driven compressor, which is more simple in its construction than known machines in this field.

This object is according to the invention attained in that a machine of the introductionally defined kind has the features specified in the characterizing portion of claim 1 of the present application.

A machine according to the invention has the advantages of being very compact and simple in its construction and requiring a minimum of ports for the supply and discharge of the working medium since a common intermediate pressure port can be used for both the medium being compressed and the medium being expanded. It is therefore particularly suitable to be used where low weight and small dimensions are aspired, e.g. in applications in aeroplans.

The invention will be further explained by the following detailed description of preferred embodiments of the invention and with reference to the accompanying drawings.

Figure 1:
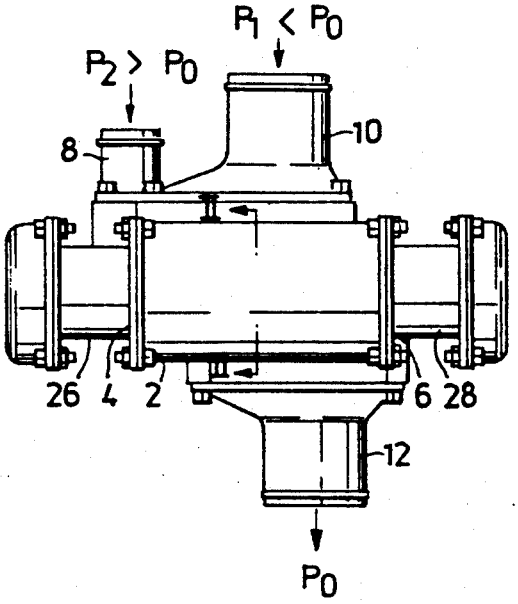
FIG. 1 is a side view of a machine according to a first embodiment of the invention.

FIG. 1 is a side view of a machine according to a first embodiment of the invention. The casing, composed of two end walls 4 and 6 and a barrel wall 2 extending therebetween, defines a working space in which two rotors cooperate. Outside the end walls 4 and 6, there are bearing housings 26 and 28. The machine has a first inlet channel 8 for pressurized air, a second inlet channel 10 for vacuum and a common outlet channel 12 leading to atmospheric pressure.

Figure 2:
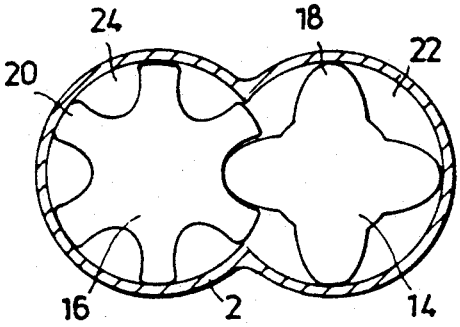
FIG. 2 is an enlarged section along line II—II in FIG. 1.

As can be seen in FIG. 2 the working space formed by the casing has the shape of two intersecting cylinders and contains a male rotor 14 and a female rotor 16. The male rotor 14 has four helically extending lobes 18 and intermediate grooves 22 and the female rotor 16 has six lobes 20 and intermediate grooves 24. The rotors intermesh through the lobes 18, 20 and grooves 24, 22 forming working chambers between the rotors and the walls 2, 4, 6 of the casing. The working chambers travel axially along the machine as the rotors rotate, thereby changing their volumes. The volume of each working chamber starts from zero at one end of the machine and rises continuously up to a maximum, from which it then decreases down to zero again at the other end of the machine. These volume changes are used for expansion and compression of air by providing ports for supply and withdrawal of air of different pressures at the relevant locations of this cycle.

Figure 3:
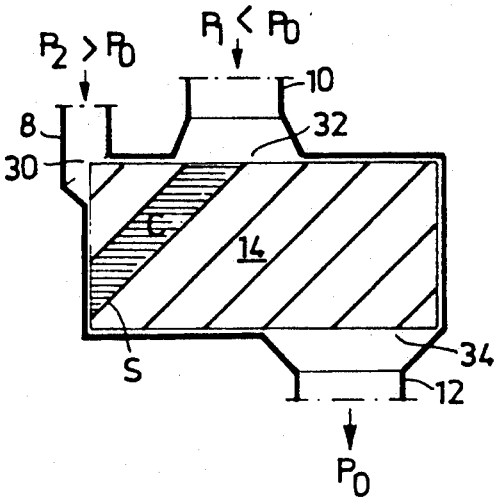
FIG. 3 is a simplified side view of the male rotor of the machine in FIG. 1.

How these ports are located relative to the expanding and decreasing working chambers can best be understood from FIG. 3, schematically showing the male rotor 14 in a side view. The tips of the lobes form sealing lines S with the barrel wall and between two sealing lines a chamber C is formed. The chamber register with a similar chamber formed by the lobes of the female rotor and together they constitute a working chamber of chevronlike shape. For the purpose of understanding the working process it is sufficient to regard only the part of the working chamber which can be seen in the figure. At operation each working chamber C passes five phases during its complete working cycle; A first filling phase, an expansion phase, a second filling phase, a compression phase and a discharge phase.

At the upper left end of the machine as viewed in FIG. 3 pressurized air of a pressure $p_2$ above atmospheric pressure is supplied from the high pressure inlet channel 8 through a high pressure inlet port 30 to a working chamber, in which the volume is rising from zero to a comparatively small value $V_1$, when communication with the high pressure inlet port 30 is cut off by the trailing sealing line of the working chamber. This constitutes the first filling phase.

As the working chamber then travels further to the right in the figure its volume increases further causing a decrease in the pressure. This expansion phase continues until the leading sealing line of the working chamber reaches the low pressure inlet port 32. At this moment the volume of the working chamber has increased to $V_2$, large enough for creating a vacuum of a pressure $p_1$ in the working chamber.

When the leading sealing line of the working chamber has reached the low pressure inlet port 32 the working chamber starts to communicate with the low pressure inlet channel 10 in which the pressure is at the same vacuum level $p_1$ to which the pressure in the working chamber has been expanded. When the working chamber is in communication with the low pressure inlet channel 10 its volume will increase still further, but the pressure will remain constant at the pressure level of the low pressure inlet channel 10, since air is sucked therefrom into the working chamber. This second filling phase ends when the working chamber has travelled so far to the right that communication with the low pressure inlet port 32 is cut off by the trailing sealing line.

The working chamber now has its maximum volume $V_3$ and the compression phase starts in that the volume of the working chamber starts to decrease. The compression continues until the leading sealing line reaches the outlet port 34. The outlet port 34 is located such that the pressure in the working chamber has been raised to atmospheric pressure $p_0$ when the working chamber comes into communication therewith. The volume at this moment has decreased to $V_4$.

The air of atmospheric pressure is then discharged to the surrounding atmosphere through the outlet port 34 during the discharge phase of the working cycle as the volume of the working chamber decreases from $V_4$ to zero.

As is apparent from the above description of the working cycle the machine includes an expansion section and a compression section. The expansion section is constituted by those working chambers that communicate with the high pressure inlet port and those working chambers in which the air expands before the chambers are brought into communication with the low pressure inlet port 32. The compression section is constituted by the rest of the working chambers. The locations of the ports and the dimensions of the machine are such that the work generated in the expansion section equals the work required for driving the compression section.

Figure 4:
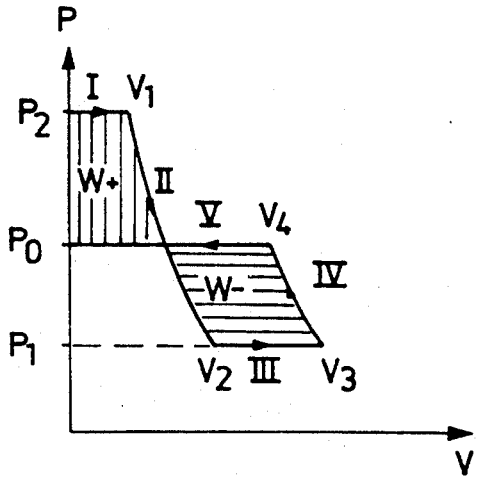
FIG. 4 is a diagram illustrating the working process of the machine in FIGS. 1 to 3.

The working cycle is in FIG. 4 illustrated by a pV-diagram, indicating the five phases thereof.

I is the first filling phase from $V=0$; $p=p_2$ to $V=V_1$; $p=p_2$

II is the expansion phase from $V=V_1$; $p=p_2$ to $V=V_2$; $p=p_1$

III is the second filling phase from $V=V_2$; $p=p_1$ to $V=V_3$; $p=p_1$

IV is the compression phase from $V=V_3$; $p=p_1$ to $V=V_4$; $p=p_0$

V is the discharge phase from $V=V_4$; $p=p_0$ to $V=0$; $p=p_0$

Figure 5:
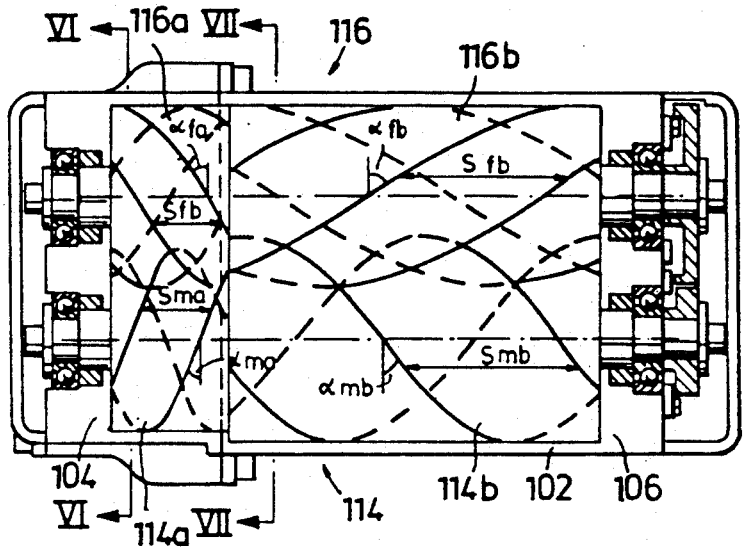
FIG. 5 is a top view of a machine according to a second embodiment of the invention, the upper half of the casing being removed.
Figure 6:
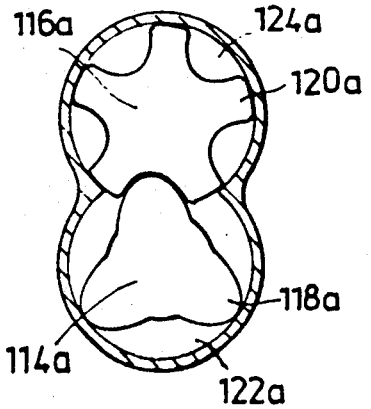
FIGS. 6 and 7 are sections taken along lines VI—VI and VII—VII, respectively, of FIG. 5.
Figure 7:
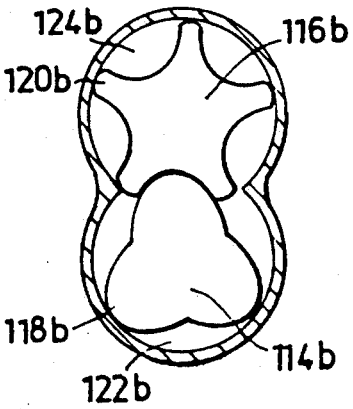

FIG. 5 illustrates a second embodiment of the invention and is a top view thereof, where the upper part of the casing is left out. In this embodiment each of the two rotors 114 and 116 is divided into two parts of different shape, thereby forming an expansion section and a compression section. The male rotor 114 thus is composed of an expansion part 114*a* and a compression part 114*b* and the female rotor 116 of an expansion part 116*a* and a compression part 116*b*. The pitch angle $\alpha_{ma}$, $\alpha_{fa}$ of the spiral on each expansion part 114*a* and 116*a* is smaller than the pitch angle $\alpha_{mb}$, $\alpha_{fb}$ of the spiral on each corresponding compression part 114*b* and 116*b*. And the axial pitch $S_{ma}$, $S_{fa}$ of each expansion part 114*a* and 116*a* is smaller than the axial pitch $S_{mb}$ and $S_{fb}$ of each corresponding compression part 114*b* and 116*b*. Furthermore the direction of the spirals on the two parts of each rotor are opposed relative to each other. The diameter of the female rotor 116 is the same for its two parts 116*a* and 116*b*, whereas the male rotor compression part 114*b* has a larger diameter than the male rotor expansion part 114*a*. The shape of the rotors in planes perpendicular to the rotor axes can be seen in FIGS. 6 and 7 showing transverse sections through the expansion section and the compression section, respectively. Both parts of the male rotor 114 have three lobes 114*a*, 118*b* with intermediate grooves 122*a*, 122*b* but differ in shape. Both parts of the female rotor 116 have five lobes 120*a*, 120*b* with intermediate grooves 124*a*, 124*b* and differ in shape.

A high pressure inlet port is provided at the left end as viewed in FIG. 5 of the expansion section for the supply of pressurized air, and a low pressure inlet port is provided at the right end of the compression section for the supply of air at vacuum level. Where the two sections meet there is a common outlet port leading to atmospheric pressure. None of these ports can be seen in FIG. 5, but are shown in the schematic FIG. 8.

Figure 8:
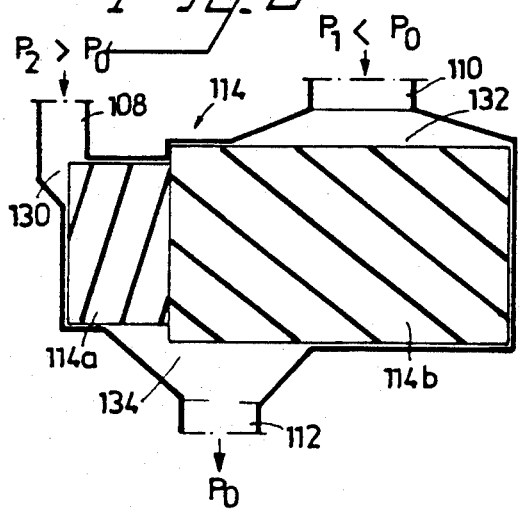
FIG. 8 is a simplified side view of the male rotor of the machine in FIG. 5.

FIG. 8 schematically illustrates how the machine operates and shows the male rotor 114 in a simplified side view. At the upper left end, as seen in the figure, of the expansion section air of a pressure $p_2$ above atmospheric pressure is supplied from a high pressure inlet channel 108 through a high pressure inlet port 130 into the expansion section of the working space, where the expansion part 114*a* of the male rotor and the related cooperating part of the female rotor (not shown) expand the air to atmospheric pressure $p_0$. The air of atmospheric pressure leaves the machine through a common outlet port 134 to an outlet channel 112. At the upper right part of the compression section air of a pressure $p_1$ below atmospheric pressure is supplied to the compression section of the working space from a low pressure inlet channel 110 through a low pressure inlet port 132. The air is compressed to atmospheric pressure by the compression part 114*b* of the male rotor and the related cooperating part of the female rotor. The compressed air of atmospheric pressure leaves the machine through the common outlet port 134 together with the air from the expansion section.

There is no partition wall between the two sections where the expansion parts and the compression parts of the rotors meet. Due to the fact that the ports are so located that the pressurized air is expanded to the same pressure as the pressure to which the vacuum is compressed, i.e. atmospheric pressure, there is no need for separating the two sections by such a partition wall.

Figure 9:
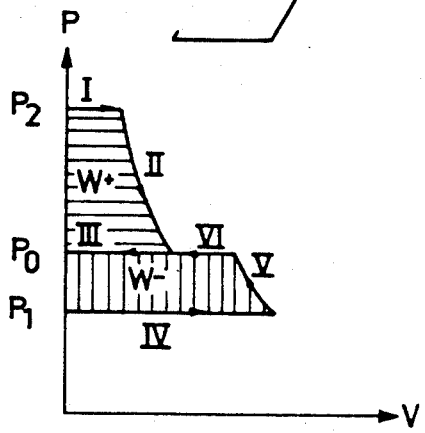
FIG. 9 is a diagram illustrating the working process of the machine in FIGS. 5 to 8.

The working process is illustrated in a pV-diagram in FIG. 9. The upper part of the diagram represents the expansion and the lower part the compression.

A machine according to the invention, as exemplified by the two embodiments thereof described above, offers a simple and reliable way of producing and maintaining a certain vacuum level using pressurized air as the only driving source, and having one single working space for both the driving and the working. In particular the embodiment shown in FIGS. 1 to 4 entails considerable advantages, since one single pair of uniform rotors simultaneously acts as an expander and a compressor and thus requires no special measures for matching these two to each other, which otherwise would be necessary. In addition the manufacture of the rotors will be simple, as, due to their uniform shape, only one cutting process is required for each rotor.

As earlier mentioned the small dimensions and light weight which can be attained with a machine according to the invention makes it particularly suitable for installations in an aeroplan for producing vacuum, e.g. for use in its vacuum toilet system.

The embodiments of the machine described above can be modified for use in other applications. By connecting the low pressure port to a channel of atmospheric pressure it can be used in situations when pressurized air is available but there is a requirement of pressurized air of lower pressure. The waste of energy which occurs when simply throttling the pressurized air to the required level thereby is avoided, since the energy of the expansion of the high pressure air to the required level is made use of for compressing atmospheric air to this pressure level.

Figure 10:
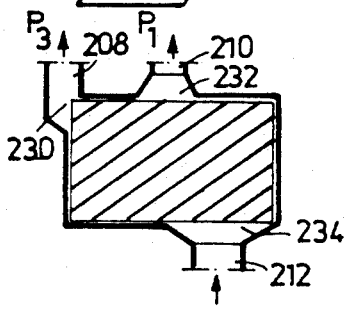
FIGS. 10 and 11 are simplified side views of the male rotor in machines according to further embodiments of the invention.
Figure 11:
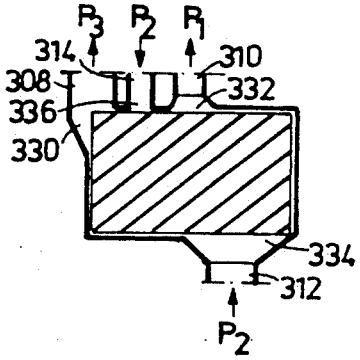

Still further modifications of the machine are schematically illustrated in FIGS. 10 and 11, showing applications where the machine is used for amplifying pressure. In FIG. 10 pressurized air of pressure $p_2$ is supplied from the intermediate pressure channel 212 to the machine and expands therein to atmospheric pressure $p_1$. A part of the expanded air is discharged through the low pressure port 232 connected to a channel 210 of atmospheric pressure. After the working chamber is cut off from communication with the low pressure port 232 the remaining air of atmospheric pressure is compressed to a pressure $p_3$ exceeding the inlet pressure $p_2$ and leaves the machine through the high pressure outlet port 230.

FIG. 11 shows a machine which is modified in comparence with the one shown in FIG. 10 in that there is provided a second intermediate pressure inlet port 336. Through this port air of the same pressure $p_2$ as the air in the common intermediate pressure inlet port 334 is supplied to a working chamber after communication between the working chamber and the low pressure outlet port 332 is cut off. Instead of starting the compression phase from the pressure level $P_1$ as in FIG. 10, the air of pressure $P_2$, supplied to the working chamber through port 334 as soon as the chamber is brought out of communication with port 332, raises the pressure to $P_2$ before the actual compression phase begins. The compression thus starts from a higher pressure level than in the embodiment of FIG. 10.

Figure 12:
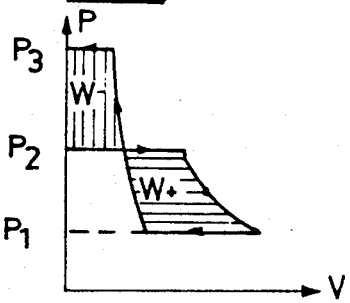
FIGS. 12 and 13 are diagrams illustrating the working process of the machines in FIGS. 10 and 11, respectively.
Figure 13:
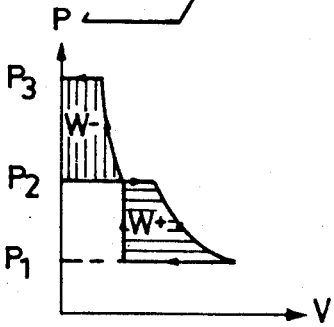

FIGS. 12 and 13 illustrate in pV-diagrams the working process of the machines of FIGS. 10 and 11, respectively.

As illustrated by the different embodiments of the machine described above its advantages can be made use of in many different applications for converting pressures to desired levels. Thus, it can be used as a vacuum producer or as a pressure amplifier or for reducing pressure in such a way that the amount of air at the reduced pressure level is larger than the amount of supplied high pressure air.

I claim:

1. A machine of the rotary screw type for use with a gaseous medium, the rotary screw type machine having a compression section and an expansion section driving the compression section, said machine further comprising:

one male rotor (14) and one female rotor (16) operating in a single working space having the general shape of two intersecting cylinders and forming said compression and expansion sections for the gaseous medium, each of said rotors (14, 16) being uniform and being provided with helical lobes (18, 20) and grooves (22, 24) of uniform shape, pitch angle and axial pitch over their entire respective rotor lengths, said rotors (14, 16) intermeshing through said grooves (22, 24) to form chevron-shaped working chambers which in said expansion sections have continuously increasing volume and which in said compression section have continuously decreasing volume; and a housing limiting said single working space and having first and second end walls (4, 6) and a barrel wall (2) extending therebetween, one low pressure port (32; 232; 332), one high pressure port (30; 230; 330) and intermediate pressure port means (34; 234; 334, 336).

2. A machine according to claim 1, wherein said low pressure port is an inlet port (32) for the compression section, said high pressure port is an inlet port (30) for the expansion section, and said intermediate pressure port means is a common outlet port (34) for the compression and expansion sections.

3. A machine according to claim 1, wherein said low pressure inlet port (32) communicates with a vacuum channel (10), said high pressure inlet port (30) communicates with a channel (8) of a pressure above atmospheric pressure, and said common intermediate pressure outlet port (34) communicates with a channel (12) of atmospheric pressure.

4. A machine according to claim 1, wherein said low pressure port is an outlet port (232) for the expansion section and communicates with a channel (210) of atmospheric pressure, said high pressure port is an outlet port (230) for the compression section, and said intermediate pressure port means is a common inlet port (234) for the compression and expansion sections.

5. A machine according to claim 1, wherein said low pressure port is an outlet port (332) for the expansion section and communicates with a channel (310) of atmospheric pressure, said high pressure port is an outlet port (330) for the compression section, and said intermediate pressure port means comprises a first inlet port (334) common for both the compression and expansion sections and a second inlet port (336) for the compression section.

* * * * *